United States Patent [19]

Roberts et al.

[11] 3,938,200

[45] Feb. 17, 1976

[54] CONTAMINATION PREVENTION SYSTEM FOR BATHTUB

[75] Inventors: Thomas J. Roberts, Elk Grove; Donald L. Paulson, Rolling Meadows, both of Ill.

[73] Assignee: Borg-Warner Corporation, Chicago, Ill.

[22] Filed: June 30, 1975

[21] Appl. No.: 591,375

[52] U.S. Cl. ..... 4/173 R; 4/DIG. 18

[51] Int. Cl.[2] ..... A47K 13/00

[58] Field of Search ..... 4/173, DIG. 18

[56] References Cited

UNITED STATES PATENTS

| | | | |
|---|---|---|---|
| 1,681,294 | 8/1928 | Henry | 4/DIG. 18 |
| 2,671,907 | 3/1954 | Sterling | 4/DIG. 18 |
| 2,806,227 | 9/1957 | Arbetter | 4/DIG. 18 |
| 2,817,851 | 12/1957 | Barnwell | 4/DIG. 18 |
| 2,853,714 | 9/1958 | Darmstadt | 4/DIG. 18 |
| 3,024,471 | 3/1962 | Anderson | 4/DIG. 18 |
| 3,045,254 | 7/1962 | Cook et al. | 4/DIG. 18 |
| 3,187,350 | 6/1965 | Steven | 4/DIG. 18 |
| 3,460,167 | 8/1969 | Benjamin | 4/173 |

*Primary Examiner*—Robert I. Smith
*Attorney, Agent, or Firm*—James E. Tracy

[57] ABSTRACT

Cross-contamination of the patients using the same bathtub in a health-care institution is precluded by lining the tub, before it is filled with water, with a disposable sheet of biologically-clean, flexible plastic film, thereby establishing a physical barrier to prevent any contact (and consequently a transmission path for bacteria) between the bathtub and patient and between the tub and water. Openings are made along the liner's edges in order to hang the liner onto a series of hooks affixed to the three walls surrounding the tub, the hooks being appropriately shaped so that they can be used by the installer to pierce or puncture the liner to make the openings. The liner is merely draped over the front of the tub. Installation is expedited and made easier by providing a series of markers, such as printed rings, along the edges of the liner to designate the areas that should be pierced to achieve proper positioning and centering of the liner within the bathtub.

7 Claims, 7 Drawing Figures

FIG. 1
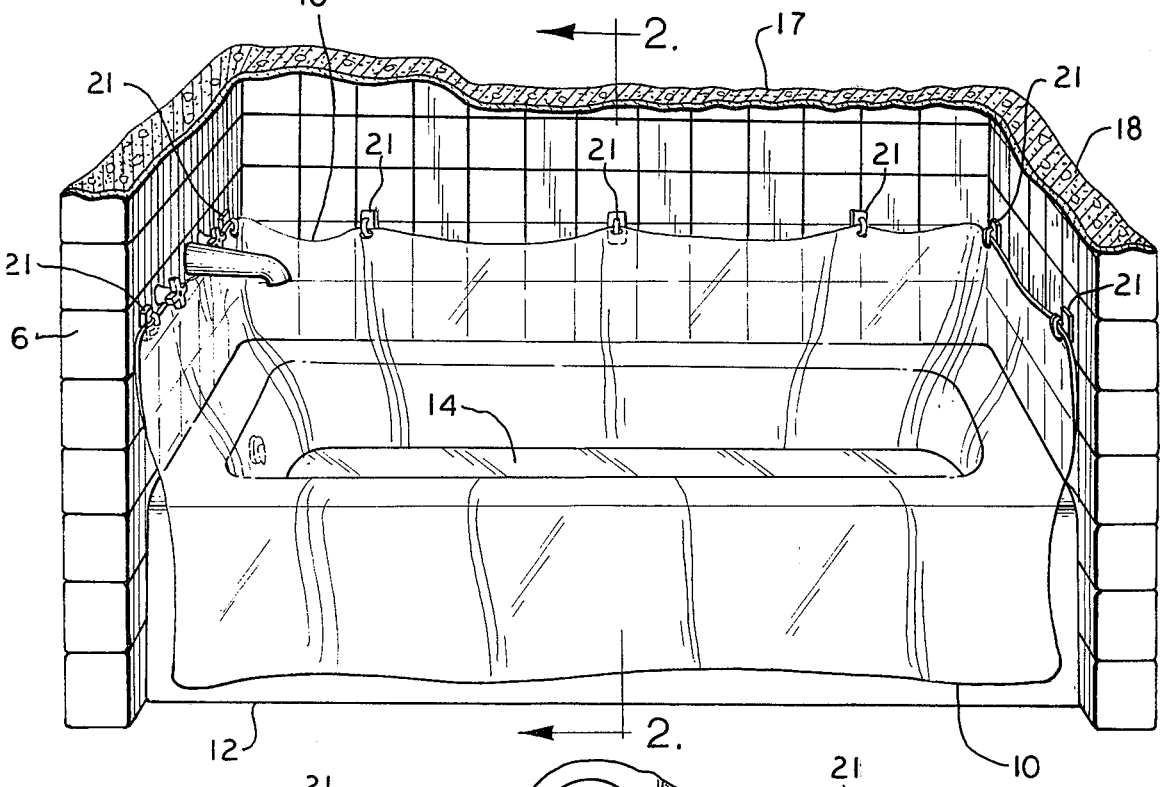
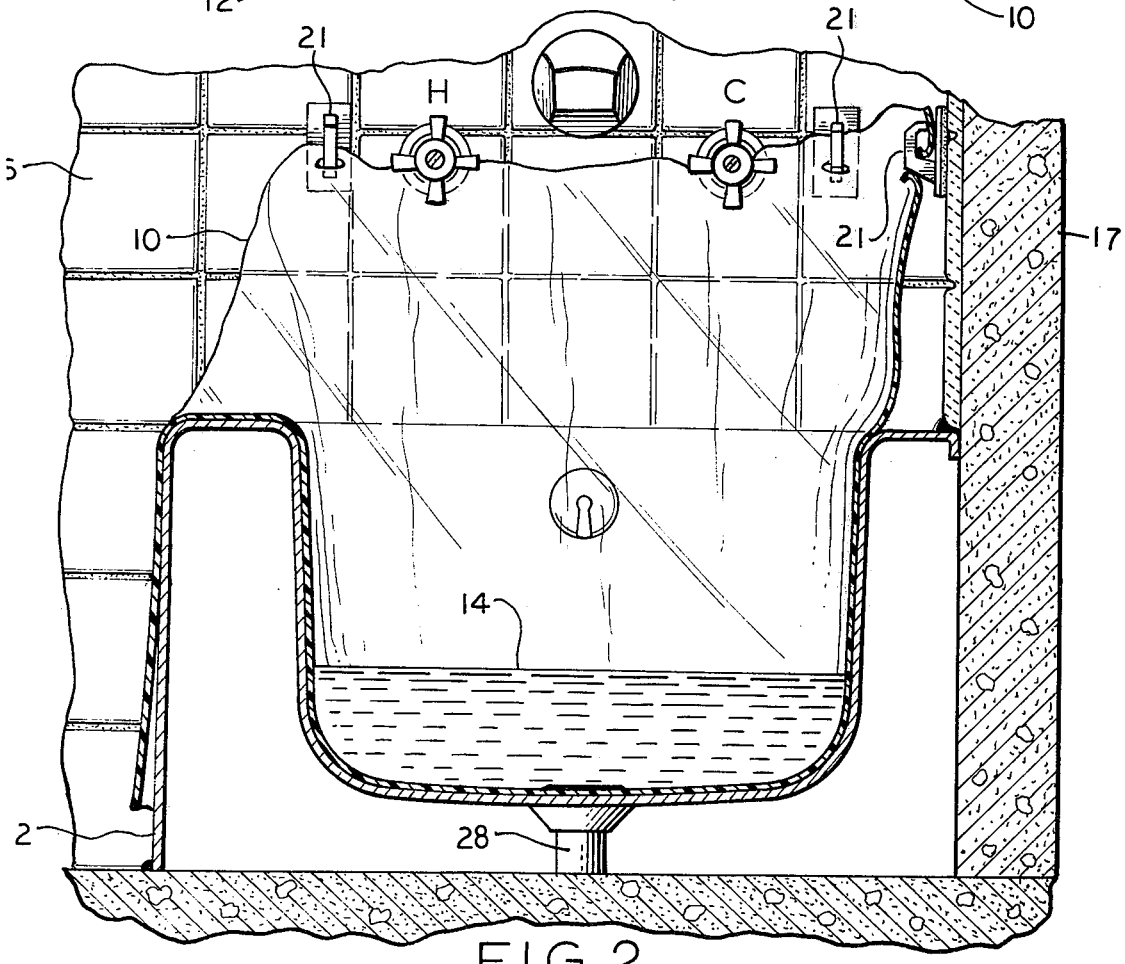
FIG. 2

FIG. 3
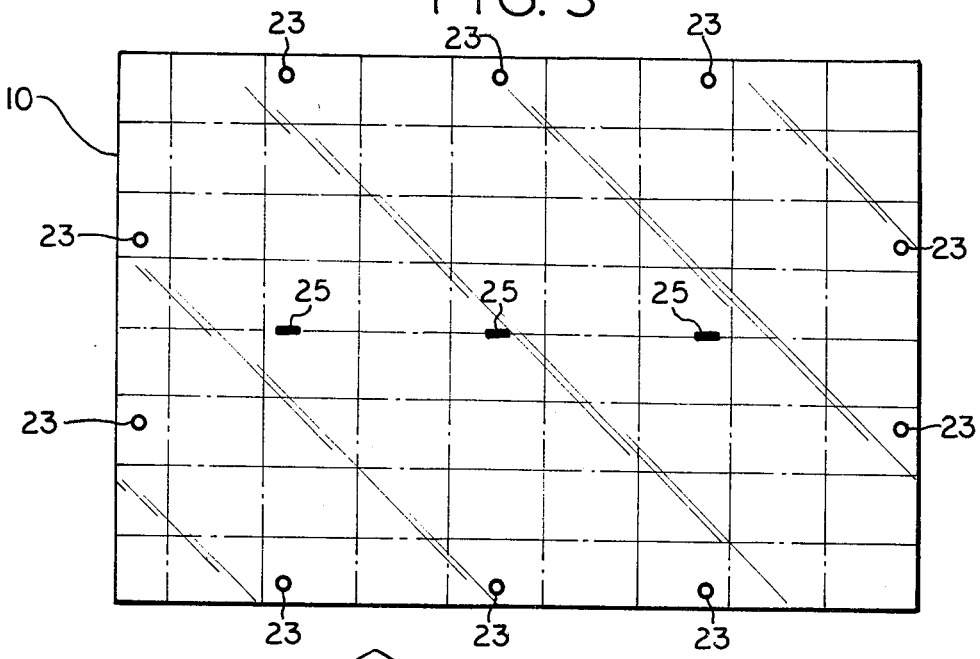
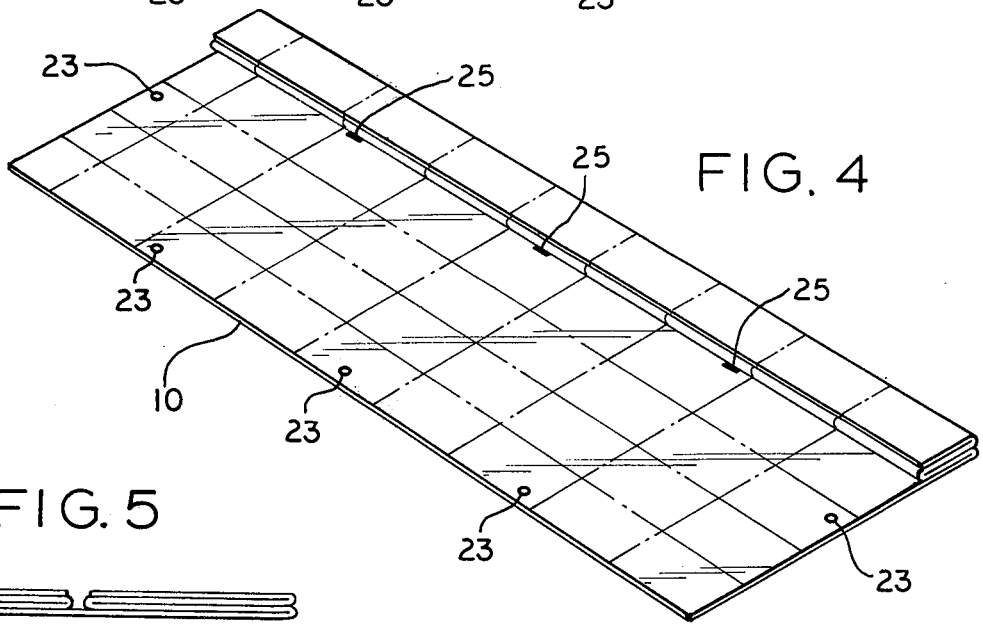
FIG. 4
FIG. 5
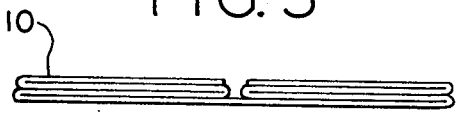
FIG. 7
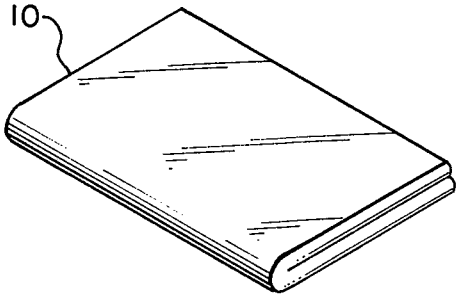
FIG. 6
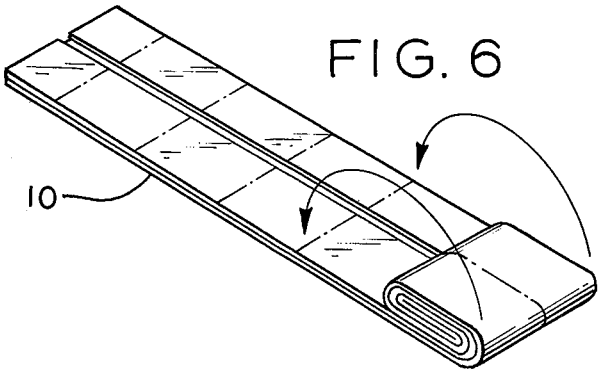

CONTAMINATION PREVENTION SYSTEM FOR BATHTUB

BACKGROUND OF THE INVENTION

Since many of the patients in a health-care institution, such as a hospital or a nursing home, may have open wounds or may be highly susceptible or vulnerable to infection-causing bacteria, it is imperative that the bathtubs in those institutions be thoroughly cleaned and sterilized each time they are used so that the patients will not become infected. Unfortunately, complete sterilization of bathtubs is a time-consuming task. All of the surfaces of the tub that the patient may contact, or that may be in contact with the water, must be brush cleaned. Soaking in a germ-killing solution is not enough.

The present invention provides a low-cost contamination prevention system which obviates the need to sterilize a bathtub each time it is used. With the uniquely constructed and easily installed system of the invention, it is impossible for any bacteria to be transferred from a bathtub to a patient, even though the bathtub is not sterilized. By the same token, there is also no way for bacteria to be conveyed from that patient to the bathtub.

SUMMARY OF THE INVENTION

The contamination prevention system of the invention is to be installed in conjunction with a bathtub in a bathroom of a health-care institution to prevent the various patients that use the bathtub from cross-infecting each other, where the two ends and the back of the bathtub are built into the bathroom walls. The system comprises a series of hooks affixed to the three bathroom walls, surrounding the bathtub, at predetermined spaced-apart locations. A disposable, flexible, flimsy, water-tight, non-toxic, slip-resistant, biologically-clean, rectangular-shaped liner, made of transparent plastic film, is provided for lining the entire inside of the bathtub, before it is filled with water, to establish a barrier to block the transmission of bacteria between the water and bathtub to preclude cross-infections between patients. The peripheral edge portions of the liner adjacent to the bathroom walls have a series of openings at predetermined spaced-apart areas to facilitate hanging of the liner from the hooks, the openings being made by using the hooks to pierce the liner. The edge portion adjacent to the front of the bathtub is draped thereover. A series of spaced-apart markers are provided on the liner, each of which markers corresponds to a respective assigned one of the hooks, to designate the predetermined areas where the liner should be pierced, to make the openings, and hung onto the hooks, thereby aiding the installer in expediting the proper positioning and centering of the liner within the bathtub.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

FIG. 1 is a perspective view of a built-in bathtub having installed therein a contamination prevention system constructed in accordance with the invention;

FIG. 2 is a sectional view taken along the plane of section line 2—2 in FIG. 1;

FIG. 3 is a plan view of a portion of the contamination prevention system; specifically, it discloses the plastic film liner and the markers thereon; and, FIGS. 4, 5, 6 and 7 are various views of the liner of FIG. 3 and illustrate the manner in which it is folded before installation in the bathtub shown in FIG. 1.

DESCRIPTION OF THE ILLUSTRATED EMBODIMENT

The principal element of the contamination prevention system is the liner 10 which preferably takes the form of a disposable, flexible, flimsy, water-tight, non-toxic, slip-resistant, biologically-clean, rectangular-shaped sheet of transparent polyethylene plastic. It should have a thickness of less than 4 mils or 0.004 inches. Excellent results have been achieved with a specific thickness of 1.75 mils. Furthermore, plastic film liner 10 should not contain any leachables. In other words, there should be no ingredients that will bleed or dissolve into water.

Liner 10 is, of course, placed inside of bathtub 12 before the tub is filled with water 14. Since the liner is flimsy, and consequently cannot support itself, and since the bathtub is usually built into three walls, as is the case illustrated in FIGS. 1 and 2 by walls 16, 17 and 18, provision must be made to hold or support the edges of the liner adjacent to those walls so that the liner extends well over the top of the tub where it meets walls 16, 17 and 18. The edge portion of liner 10 adjacent to the front of the bathtub is merely draped thereover. In this way, a patient using the tub will be completely isolated from the bathtub surfaces so that no bacteria can be transferred from those surfaces to the patient or vice versa.

In accordance with a feature of the invention, liner 10 is hung to the walls by means of a series of hooks 21, preferably made of plastic, that are affixed or attached, such as by cementing, to the walls at predetermined spaced-apart locations. To hang the liner from hooks 21, the installer uses the hooks themselves to pierce or puncture the liner to provide the necessary openings to hang onto the hooks. As best seen in FIG. 2, plastic hooks 21 are sufficiently pointed to facilitate piercing of liner 10, but yet are sufficiently blunt and are appropriately shaped so that a patient in the bathtub cannot be injured if he accidently falls against the hooks.

Fast installation is made possible by providing a series of spaced-apart markers, preferably in the form of printed rings 23 (see FIG. 3), along the peripheral edge portions of liner 10. When the liner is properly centered and positioned in bathtub 12, each of the markers 23 on the three edges adjacent to the bathroom walls will line up with a respective assigned one of hooks 21. With this arrangement, markers 23 will designate the predetermined areas where the liner should be pierced, to make the openings, and hung onto the hooks, thereby aiding the installer. Of course, markers 23 are printed on all four edge portion so that the liner may be installed in either one of two ways. This provides an additional degree of convenience.

The installer is also assisted in centering the liner by means of markers 25 printed on the liner to indicate the center line running the length of the liner. When liner 10 is placed in the bathtub, the center line designated by markers 25 is aligned with the middle of the bathtub. The edges of the liner will therefore be appropriately positioned with respect to hooks 21.

Another feature of the invention resides in the manner in which the liner is folded, before installation, so that it may be unfolded in the bathtub by the installer without ever touching the liner's surface that contacts the water, thereby precluding contamination of that surface by the installer in order that it will remain biologically clean during installation. The folding technique is shown by FIGS. 3–7. All of the dashed construction lines in those figures illustrate fold lines, namely the lines along which the liner is folded. Of course, the thickness of liner 10 is exagerated in FIGS. 3–7 to illustrate the folding technique more clearly. Starting from the completely unfolded position as shown in FIG. 3, each half of liner 10 is folded accordion style in the manner shown in FIGS. 4 and 5, the latter figure being an end view of the liner after both halves are folded as shown in FIG. 4. It will be noted that at this stage there will be a center slit running the length of the liner and through which the center line markers 25 will be visible. From the FIG. 5 position, the liner is then folded as shown in FIG. 6 and then as shown in FIG. 7.

In installing the liner in the bathtub, the installer lays the completely folded liner (FIG. 7) in the tub and unfolds it to the position shown in FIG. 6, in the meantime making certain that the center slit and the center line markings 25 are lined up with the middle of the bathtub. The liner is then unfolded by grasping the exposed edges adjacent to the center slit and extending the liner to the completely unfolded position shown in FIG. 1. The areas designated by ring-shaped markers 23 are then punctured, to make the necessary openings, by forcing those areas over hooks 21. Note that during the entire unfolding process, the installer never has to touch the inside surface of the liner.

With the liner properly installed, the tub is then filled with water and a patient may now take a bath. The liner provides an excellent barrier to block the transmission of bacteria so there is no way for bacteria to travel from the bathtub to the patient or vice versa. Hence, cross-infections between the various patients using the bathtub are precluded. At the conclusion of the bath, the water in the tub is drained by puncturing the liner in the vicinity of the drain 28. The liner is then disposed of since it will now be contaminated with bacteria from the patient.

The invention provides, therefore, a unique and easily installed contamination prevention system for ensuring that absolutely no bacteria will be transferred to a patient when he uses a bathtub in a health-care institution.

While a particular embodiment of the invention has been shown and described, modifications may be made, and it is intended in the appended claims to cover all such modifications as may fall within the true spirit and scope of the invention.

We claim:

1. A contamination prevention system to be installed in conjunction with a bathtub in a bathroom of a health-care institution to prevent the various patients that use the bathtub from cross-infecting each other, where the two ends and the back of the bathtub are built into the bathroom walls, comprising:

a series of hooks affixed to the three bathroom walls, surrounding the bathtub, at predetermined spaced-apart locations;

a disposable, flexible, flimsy, water-tight, non-toxic, slip-resistant, biologically-clean, rectangular-shaped liner, made of transparent plastic film, for lining the entire inside of the bathtub, before it is filled with water, to provide a barrier to block the transmission of bacteria between the water and bathtub to preclude cross-infections between patients, the peripheral edge portions of said liner adjacent to the bathroom walls having a series of openings at predetermined spaced-apart areas to facilitate hanging of said liner from said hooks, said openings being made by using said hooks to pierce said liner, and the peripheral edge portion adjacent to the front of the bathtub being draped thereover;

and a series of spaced-apart markers on said liner, each of which corresponds to a respective assigned one of said hooks, to designate the predetermined areas where said liner should be pierced, to make said openings, and hung onto said hooks, thereby aiding the installer in expediting the proper positioning and centering of said liner within the bathtub.

2. A contamination prevention system according to claim 1 in which said markers are small rings printed on said liner.

3. A contamination prevention system according to claim 1 in which the center line running the length of said liner is aligned with the middle of the bathtub, and in which that center line is marked to facilitate easier positioning of said liner within the bathtub.

4. A contamination prevention system according to claim 1 in which said liner contains no leachables.

5. A contamination prevention system according to claim 1 in which said liner is made of polyethylene, having a thickness of less than 4 mils.

6. A contamination prevention system according to claim 1 in which said liner is folded, before installation, in such a way that it may be unfolded in the bathtub by the installer without ever touching the liner's surface that contacts the water, thereby precluding contamination of that surface by the installer in order that it will remain biologically clean during installation.

7. A contamination prevention system according to claim 1 in which said hooks are sufficiently pointed to facilitate piercing of said liner, but are sufficiently blunt and are appropriately shaped so that the patient cannot be injured if he accidentally falls against said hooks.

* * * * *